United States Patent [19]

Hashimoto

[11] Patent Number: 4,500,220

[45] Date of Patent: Feb. 19, 1985

[54] MECHANICAL PENCIL WITH REMOVABLE LEAD FEED COVER

[75] Inventor: Junichi Hashimoto, Tokyo, Japan

[73] Assignee: Pentel Kabushiki Kaisha, Tokyo, Japan

[21] Appl. No.: 420,294

[22] Filed: Sep. 20, 1982

[51] Int. Cl.[3] ..... B43K 21/02; B43K 21/22; B43K 9/00

[52] U.S. Cl. ..... 401/53; 401/60; 401/65; 401/67; 401/98; 401/102

[58] Field of Search ..... 401/65, 67, 81, 80, 401/62, 94, 98, 102, 61, 53, 59, 60, 102

[56] References Cited

U.S. PATENT DOCUMENTS

| | | | |
|---|---|---|---|
| 846,547 | 3/1907 | Brown | 401/102 |
| 2,311,906 | 2/1943 | Eistenschneider | 401/65 |
| 2,865,330 | 12/1958 | Swank | 401/53 |
| 4,270,870 | 6/1981 | Hashimoto et al. | 401/65 X |

FOREIGN PATENT DOCUMENTS

| | | | |
|---|---|---|---|
| 1342004 | 9/1963 | France | 401/53 |
| 13092 | 7/1893 | United Kingdom | 401/102 |

*Primary Examiner*—Steven A. Bratlie
*Attorney, Agent, or Firm*—Wenderoth, Lind & Ponack

[57] ABSTRACT

A mechanical pencil includes a removable tubular cover which has functions to protect a tip of the pencil and also to advance automatically the lead therein a tiny increment to project from the pencil tip when it is attached to a rear end of the pencil for writing purposes and to a front end of the pencil after writing is finished.

6 Claims, 7 Drawing Figures

MECHANICAL PENCIL WITH REMOVABLE LEAD FEED COVER

BACKGROUND OF THE INVENTION

The present invention relates to a mechanical pencil with a tubular endcap or cover to be attached to a rear end of the pencil body, wherein manual actuation of an actuation button projecting rearwardly from the cover advances the lead contained within the pencil body.

The removable cover of a known mechanical pencil has a function to protect a tip of the pencil, and a function to aid carriage in the pocket of the user if the cover is provided with a clip on the outer surface thereof. With such known pencils, however, after the cover is removed from the pencil tip and then mounted on the rear end of the pencil for writing purposes, the actuation button, which is designed to be engaged with a lead feed mechanism within the pencil body, must be actuated manually. If the lead is already placed in the tip or sleeve of the pencil such that a front end of the lead is flush with the front end of the pencil tip, the actuation button must be operated manually by, in general, pressing the button towards the pencil tip two times. The two-time operation is based upon the fact that a projection length, or increment, of the lead from the pencil tip is generally and desirably selected to be, for example, about 1.0 mm in accordance with the mechanical strength of the lead. When the lead is worn during writing with a small length, for example about 0.5 mm, of the lead still projecting from the tip, it is enough to operate the button one time so as to obtain a further increment of about 0.5 mm so that a total projecting length of the lead equals the desired length, for example about 1.0 mm. That is, the pencil is generally designed such that one operation of the actuation button can advance the lead half the desired extension length, for example about 0.5 mm. Accordingly, it is necessary to operate manually the actuation button twice when the pencil is to be used, after the endcap or cover is removed from a front portion of the pencil body and then mounted on the rear end of the pencil body.

SUMMARY OF THE INVENTION

An object of the present invention is to provide a novel mechanical pencil, in which an engagement of the cover to a front portion of the pencil body can advance the lead forward a small increment from the pencil tip.

Another object of the invention is to provide a novel mechanical pencil, in which an engagement of the cover to a rear end portion of the pencil body can advance the lead forward a small increment from the pencil tip.

Another object of the present invention is to provide a mechanical pencil with a tubular removable cover, in which the engagement of the cover to a front portion of the pencil body can advance the lead forward a tiny increment, and the engagement of the cover to a rear end of the pencil body can advance the lead forward a further tiny increment so that the lead is fully placed into a writing position immediately after the cover is mounted to the end portion of the pencil for writing purposes.

Briefly, the mechanical pencil according to the present invention has an elongated barrel, a sleeve slideably mounted within the barrel, the sleeve having a pipe projecting coaxially therefrom, a clutch device limitedly slideably mounted within the sleeve and an elastomeric ring fixed within the sleeve for frictionally holding the lead, a magazine longitudinally displaceable and biased longitudinally rearwardly within the barrel, a lead feed tube connected to the magazine and having a slit collet for tightly grasping the lead when the collet is closed, and a removable cover attachable to the barrel both at the pencil tip and at the rear end of the pencil body. The cover has a cylindrical casing, a pusher rod or actuation button longitudinally displaceably mounted within the casing with its end projecting outwardly from the rear end of the casing, and a hook device for engagement with the pusher rod and which is radially displaceable to release the engagement.

In an embodiment of the invention, the hook device, mounted within the casing, functions to hold the button in position to prevent it from moving longitudinally when the cover is mounted on the pencil tip in contact with a projecting end of the sleeve in the barrel. When the cover is moved to a fully mounted position, the sleeve is retracted, with the collet being in a closed position for grasping the lead, and the sleeve is moved relative to the feed tube and the lead to permit the lead to project outwardly from the sleeve. When the cover is then removed from the pencil body for writing purposes, the sleeve has been projected to a writing position with the lead projecting therefrom.

In a preferred embodiment of the invention, the hook device has a cylindrical base fixed to an inner surface of the cylindrical casing of the removable cover, a plurality of resilient arms extending longitudinally along the inner surface of the cylindrical casing with a space therebetween so that the arms may be radially outwardly displaced to release the engagement when the hook device is pressed against the rear end of the barrel. Preferably, the barrel has a curved or round shaped outer surface at the rear end thereof, and each of the arms has a round shaped projection to enhance the radially outwardly displacement of the arm. In a modified structure of the invention, the cylindrical casing of the cover has a projection, and the pusher rod has a plurality of arms, which arm engageable with the projection, therearound with a space to form a modified hook device so that the arms may be radially inwardly displaceable to release the engagement between the pusher rod and the projection.

DESCRIPTION OF PREFERRED EMBODIMENTS

Figure 1:
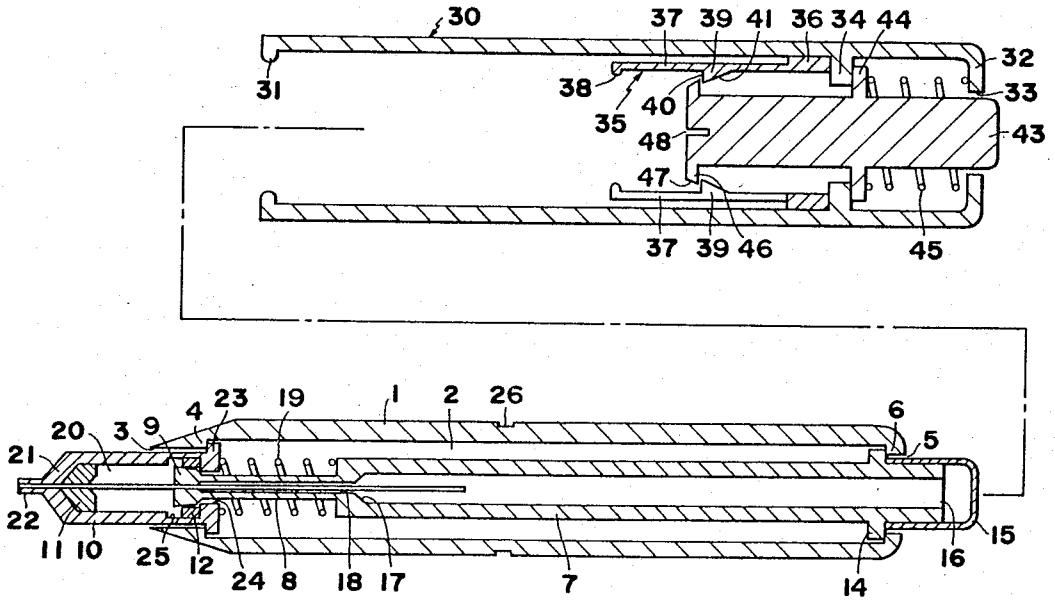
FIG. 1 is a sectional elevation of a mechanical pencil according to a preferred embodiment of the invention.

Referring first to FIG. 1, the pencil includes a cylindrical elongated casing or barrel 1 which may desirably be formed of a plastic. The barrel has a large bore 2 communicating at its front end with an a smaller bore 3 to form a shoulder 4, and communicating at its rear end with additional smaller bore 5 to form a shoulder 6. The barrel 1 has a tapered, forwardly pointed front end and a rounded outer surface at its rear end.

The barrel 1 includes therein a spare-lead container and feed mechanism. This mechanism includes a magazine 7, a feed tube 8 having jaws or a slit collet 9 for firmly clamping the lead therein, and a sleeve 10 having therein an elastomeric ring 11 for frictionally holding the lead therein and a clutch ring 12.

The magazine 7 has an annular lug 14 at its rear portion so that it can contact with the shoulder 6 of the barrel to prevent the magazine 7 from dropping out of the barrel 1. The magazine 7 is provided with a removable metal cap 15 for insertion of leads into the magazine and closing the rear end opening 16 of the magazine, and a tapered inner end 17 to form a front opening 18 through which a lead is fed into the feed tube 8.

The feed tube 8 is connected coaxially at its rear end to a front end of the magazine 7 so that a channel of the feed tube 8 is longitudinally axially aligned with the front opening 18 of the magazine 7. The feed tube 8 has at its front end the slit collet 9 of known construction for firmly grasping the lead for writing purposes and for feeding upon the next operation of the mechanism. The collet 9 is longitudinally and radially outwardly displaceable within the aforementioned sleeve 10 which functions as a "clutch" case, as will be described presently. A helical spring 19 is mounted around the feed tube 8 with its rear end and front end being abutted between the magazine 7 and the sleeve 10, respectively.

The clutch case or sleeve 10, which is slideably mounted within the barrel 1, has a bore 20, a frustoconical projection 21 and pipe 22 projecting coaxially and forwardly from the tapered end of the frustoconical projection 21. Within the sleeve 10 is fixedly disposed the elastomeric ring 11 for frictionally retaining the lead. The sleeve 10 has a rim 23 which projects outwardly to contact the shoulder 4 and which also projects radially inwardly to form a smaller bore 24 having a diameter larger than that of the feed tube 8 but smaller than the outer diameter of the collet 9. Inside the sleeve 10 is formed an annular recess 25 adjacent to the rim 23 to receive the clutch ring 12. The recess 25 is made longer than the ring 12 so that the ring can be slideable in a longitudinal direction within a limited axial distance defined by the recess.

It will be understood from the foregoing description that the helical spring 19 mounted around the feed tube 8 biases the sleeve 10 forwardly, and biases the feed tube 8 and magazine 7 rearwardly, and that the sleeve 10 can be displaced longitudinally relative to the position of the feed tube 8. Reference numeral 26 represents a groove or recess for engaging a removable outer shell or cover 30, which will be described presently, in a snap fitting relation.

The pencil according to the invention includes a generally cylindrical removable cover 30. The cover 30 in the embodiment illustrated in FIG. 1 has an inner round shaped projection 31 at its front end so that it may be fitted to, and releasably engaged with, the recess 26 in the outer surface of the barrel 1, a rear end 32 with a central opening 33, and an annular shoulder 34 projecting radially inwardly at a position spaced a certain distance from the rear end 32. The shoulder 34 is formed integrally with the cover 30. A generally cylindrical hook 35 of plastic material is fixed to the inner surface of the cover 30 at a position forwardly of the shoulder 34. The hook 35 has a cylindrical base 36 and arms 37 extending longitudinally from the base 36 along the inner surface of the cover 30. Three or more arms may be provided with constant intervals or spacings therebetween. Each arm 37 has an inwardly round shaped projection 38 at its front end and a shoulder 39 projecting inwardly. The shoulder 39 has a flat forward face 40 and a rearwardly flared or rearwardly outwardly inclined portion 41.

Within the cover 30 is mounted an actuation button or pusher rod 43 which is displaceable longitudinally. The rod 43 has a rim 44 at its middle portion for limiting forward displacement of the rod by the contact with shoulder 34 and for receiving an end of a spiral spring 45, the other end of which abuts the rear end 32 of the cover 30. The rod 43 is generally biased forwardly by the spring 45 to induce abutment between the shoulder 34 and the rim 44. The spring 45 is designed such that its spring force is weak relative to the spring force of the spring 19 which biases the magazine rearwardly. The rod has at its front end a brim 46 projecting outwardly for engagement with the shoulders 39 of the hook 35. The brim 46 has an inclined surface 47 so as to release the engagement between the shoulders 39 of the hook 35 and the brim 46 when the arms 37 are radially outwardly moved by retraction of the pencil body or barrel 1 relative to the cover 30, an operation of which will be described presently with reference to FIGS. 3 and 4. Reference numeral 48 is a hole for receiving a lead when the cover 30 is mounted to the front or tip of the pencil body, an operation which will be described with reference to FIGS. 5 and 6. The holer 48 preferably has a depth of about 1.0 mm or more to fully receive the projecting length of the lead, but the depth can be selected in accordance with the inner mechanism which functions to move the lead forwardly by steps.

Figure 2:
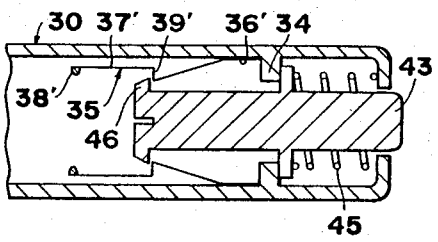
FIG. 2 is a sectional view of a modified form of an element of the pencil.

FIG. 2 shows a modified structure of the hook 35 shown in FIG. 1. In the embodiment of FIG. 2, the hook 35 has arms 37' in the form of leaf springs each having a round shaped projection 38' and a shoulder 39' at a middle portion thereof, similar to the hook 35 of the preceding embodiment. The arms 37' are fixed at a base portion 36' to the inner surface of the cover 30 adjacent to the shoulder 34. Other structure, such as a pusher rod 43 which is biased forwardly by a spring 45, is similar with that of the embodiment of FIG. 1, and further description thereof will not be made.

Figure 3:
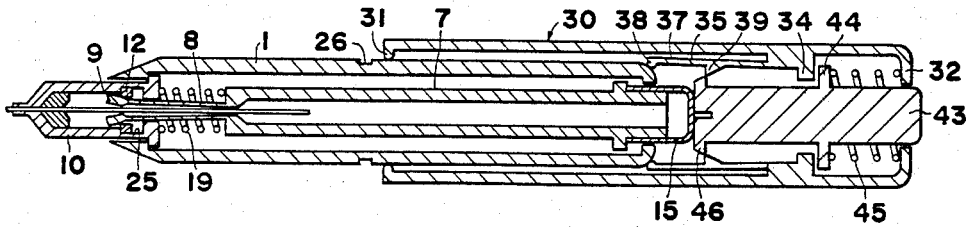
FIGS. 3 and 4 are sectional elevations of the pencil illustrated in FIG. 1, showing an operation mode and lead feed mechanism when a removable cover is attached to the rear end of the pencil body.
Figure 4:
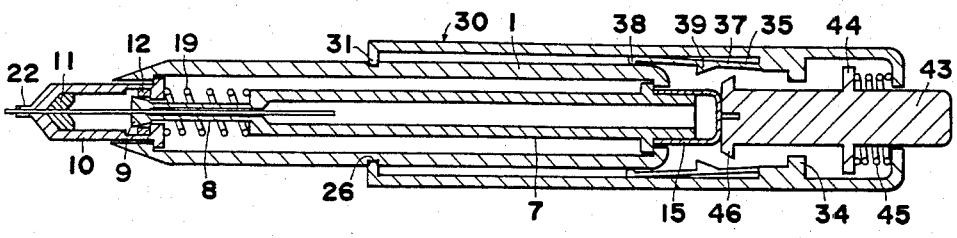

Operation of the pencil according to the present invention will be described with reference to FIGS. 3–6. With reference first to FIGS. 3 and 4, the cover 30 is attached to the pencil so that the closure cap 15 of the magazine 7 is contacted by the pusher rod 43 to induce an engagement between the shoulders 39 of the hook 35 and the brim 46 of the pusher rod 43, whereat the rod 43 is slightly retracted gainst the resilient force of the spring 45, as shown in FIG. 3. At this moment, the front ends or projection 38 of the arms 37 come into contact with and very slightly ride on the curved rear end of the barrel 1, with the engagement between the shoulders 39 and the brim 46 being maintained. Since the pusher rod 43 is engaged with, and limited in its retraction towards the rear end 32 by, the shoulders 39 of the hook 35, the magazine 7 and the feed tube 8 are pushed forward to advance towards the tip of the pencil against the force of the spring 19 with the lead being firmly held by the collet 9. Simultaneously, the clutch ring 12 travels along with the collet 9 to hold the collet in a closed position and then stops its movement by abutment with a front wall of the recess 25. After the forward movement of the ring 12 stops, the feed tube 8 is further advanced to release the engagement between the clutch ring 12 and the collet 9, and immediately thereafter the slit collet 9 of the feed tube 8 is opened to release the gripping force against the lead, as shown in FIG. 3.

When the pencil is inserted fully into the cover 30 so that the projection 31 of the cover fully fits into the recess 26 as shown in FIG. 4, the round shaped projections 38 of the arms 37 ride over the rear end of the barrel 1 to displace the arms 37 radially outwardly and to release the engagement between the shoulders 39 of the hook 35 and the brim 46 of the pusher rod 43. Upon release of the engagement, the magazine 7 and the feed tube 8 are retracted along with the clutch ring 12 by means of the spring 19 to place the pusher rod 43 into a retracted position against the force of the spring 45. The collet chuck 9 of the feed tube 8, when retracted, is closed to firmly clamp the lead therein for writing purposes. Thus, the cover 30 provides a function to step the lead forward a tiny increment, for example 0.5 mm in length, from the pipe 22 of the pencil tip. As will be understood from the foregoing description, the lead, which has been stepped forward a tiny increment as described, is retained by the frictional resistance of the elastomeric ring 11 in the sleeve 10 when the opened collet 9 is retracted by the force of the spring 19 into its retracted position, as shown in FIG. 4.

Figure 5:
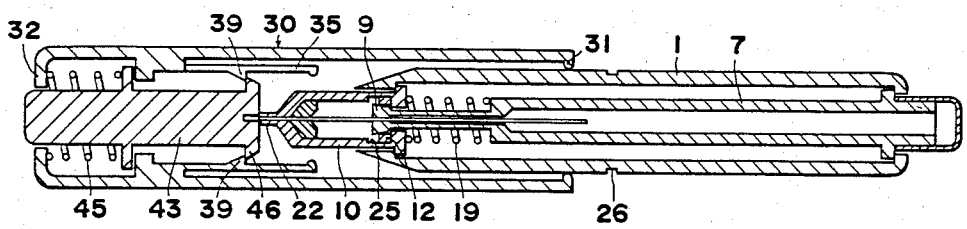
FIGS. 5 and 6 are sectional elevations of the pencil, and show an operation mode and lead feed mechanism when the removable cover is attached to the front portion of the pencil body.
Figure 6:
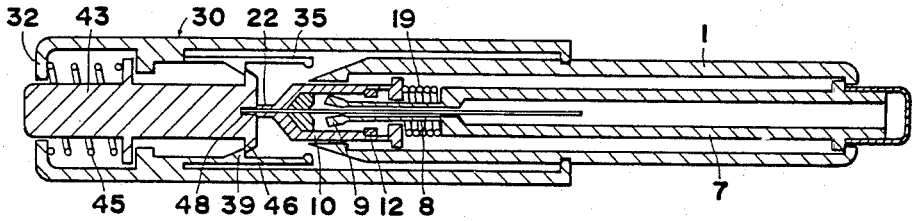

With reference to FIGS. 5 and 6 showing the removable cove 30 attached to the barrel 1 to protect the pencil tip, the pencil is inserted into the cover 30 such that the pusher rod 43 is first contacted by the pipe 22 projecting from the sleeve 10, and then engaged at its brim 46 with the shoulders 39 of the hook 35, whereat the pusher rod 43 is slightly moved towards the end 32 against the force of the spring 45, as illustrated in FIG. 5.

When the cover 30 is fully attached to the pencil with the projection 31 of the cover 30 fitting into the recess 26 of the barrel 1, the sleeve 10 is pushed further into the barrel and retracted towards the rear end of the barrel 1 against the force of the spring 19, since the engagement between the brim 46 of the pusher rod 43 and the shoulders 39 of the hook 35 is maintained. Along with the initial retraction of the sleeve 10, the clutch ring 12 moves within the recess 25 towards the pipe 22 and contacts with a front wall of the recess 25. When the sleeve 10 is retracted further to permit the lead to project a tiny increment from the pipe 22, the feed tube 8 "advances" relative to the sleeve 10, and the collet 9 opens to release the grasping force against the lead, as shown in FIG. 6. The projected lead point is received in the hole 48 of the pusher rod 43.

It will be understood from the foregoing description that the moving distance of the clutch ring 12 within the recess 25 corresponds substantially to the intended length of the increment of movement of the lead.

The cover 30, when attached to the front portion or the tip of the pencil, also provides a function to step the lead forwardly a tiny increment of, for example, about 0.5 mm. Therefore, the pencil is ready for writing without manipulating the pusher rod after the cover 30 is removed from the pencil tip and then mounted to the rear end of the pencil.

When writing is finished, with the lead still extending from the sleeve for a length of, for example, 0.5 mm, and when the cover then is mounted on the tip of the pencil body for carrying purposes, the lead is stepped to advance a further tiny increment (such as 0.5 mm), and the pencil, when the cover is removed, will be ready for writing. Of course, when the lead is worn out during writing, it is necessary to manipulate, in a manner similar to that of known devices, the pusher rod or button so as to advance the lead into a writing position.

Figure 7:
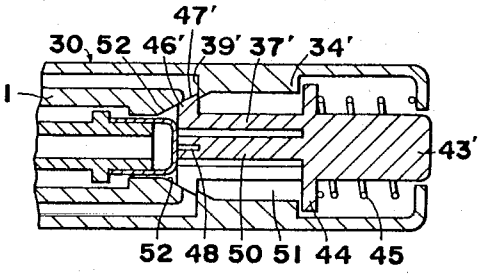
FIG. 7 is a sectional view of a part of the pencil in accordance with another embodiment of the invention.

FIG. 7 shows a modified structure of a rear end of the barrel 1 and a modified structure of the cover 30. In the modification shown in FIG. 7, the cover 30 has a rigid shoulder 39' formed integrally with a shoulder 34'. A pusher rod 43' has a rim 44 for receiving a spring 45 and for limiting the forward displacement of the rod 43' in a manner similar the pusher rod 43 of FIG. 1, and yet has a central rod portion 50 with a hole 48 at its front end, and resiliently displaceable arms 37' which are formed in parallel with and around the central rod portion 50 at a space 51. The arms 37' each have a brim 46' with an inclined surface 47'. The barrel 1 has at its rear end a backwardly flared recess 52 so that retraction of the barrel into the cover 30 forces the arms 37' to close or move towards the central rod portion 50 to thereby release the engagement between the shoulder 39' of the cover 30 and the brims 46' of the arms 37' formed integrally with the pusher rod 43'. Other structure and operation of the mechanism will be understood to be similar to those of the preceding embodiments, and further description thereof will not be made.

Though the present invention has been described with reference to the preferred embodiments thereof, many modifications and alterations may be made within the spirit of the invention.

What is claimed is:

1. A mechanical pencil having a removable cover and comprising:

an elongated tubular housing having first and second ends;

a sleeve longitudinally displaceably mounted in said housing and projecting from said first end thereof to form a pencil tip, said sleeve including an inner surface portion;

an elastomeric ring mounted in said sleeve for frictionally slideably holding a lead therein;

a lead feed tube longitudinally displaceably mounted within said housing, said feed tube including jaws for clamping the lead and a lead container projecting from said second end of said housing, said jaws being positioned within said sleeve;

first spring means for biasing said feed tube to a retracted position towards said second end of said housing;

an annular member mounted in said inner surface portion of said sleeve for longitudinally sliding movement to a position in close contact with said jaws for forcibly placing said jaws into a closed position to firmly grasp the lead therein;

a removable tubular cover capable of being attached to said tubular housing over either of said first or second ends thereof; and means for, upon mounting said cover over said first end of said housing, moving the lead to extend from said tip by retracting said sleeve inwardly of said housing against the force of said spring means for a first distance, during which said jaws are maintained in position clamping the lead and said sleeve moves relative to the lead and said feed tube, and for a second distance, during which said jaws are unclamped from the lead and said sleeve and the lead move relative to said feed tube, said moving means comprising a button member mounted within said cover coaxially therewith, said button member having a surface contacting said sleeve during retraction thereof, and said surface having therein a slot into which the free end of the lead is extended upon movement of said sleeve relative to the lead.

2. A mechanical pencil as claimed in claim 1, wherein said button member projects from a first end of said cover and is mounted therein for longitudinal displacement relative thereto, and further comprising second spring means having a spring force less than that of said first spring means for biasing said button member toward a second end opposite said first end of said cover, whereby when said cover is a position fully mounted over said second end of said housing, said first spring means biases said button member against the force of said second spring means to project from said first end of said cover, whereafter inward pressure applied to said button member against the force of said first spring means will advance said lead feed tube and the lead to feed lead from said tip, and hook means within said cover for, upon said cover being moved over said housing toward said fully mounted position, temporarily preventing movement of said button member to project from said first end of said cover and thereby for causing said button member to advance said lead feed tube and the lead and to feed lead forwardly from said tip.

3. A mechanical pencil as claimed in claim 2, wherein said button member has a brim extending radially outwardly relative to an axis thereof, and wherein said hook means includes a cylindrical base fixed to an inner surface of said removable cover, and resilient arms extending from said cylindrical base with a space between said arms and said cover so that said arms are radially outwardly movable, each said arm having a shoulder for temporary engagement with said brim of said button member.

4. A mechanical pencil as claimed in claim 3, wherein said brim of said button member has a tapered outer surface diverging towwards said first end of said cover, and said shoulder of each said arm has a flat surface for engagement with said brim and an inclined surface for facilitating disengagement between said shoulder and said brim.

5. A mechanical pencil as claimed in claim 4, wherein each said arm has a free end with a round shaped projection, thereby enhancing radially outwardly movement of said arms when said removable cover is in said fully mounted position over said housing such that said second end of said housing contacts said round shaped projections.

6. A mechanical pencil as claimed in claim 2, wherein said housing has a backwardly flared recess at said second end thereof, and said hook means include arms extending coaxially from said button member with spaces therebetween so that said arms are radially inwardly displaceable, each said arm having a projection, and said housing having a shoulder for temporarily engaging with said projections of said arms.

* * * * *